US006074113A

United States Patent [19]

Cockerill et al.

[11] Patent Number: 6,074,113

[45] Date of Patent: Jun. 13, 2000

[54] TAPE PRINTER HAVING A CUTTER WITH A GUIDE MECHANISM

[75] Inventors: Sam Cockerill, Harston; Costa Panayi, Royston, both of United Kingdom

[73] Assignee: Esselte N.V., Sint-Niklaas, Belgium

[21] Appl. No.: 09/158,893

[22] Filed: Sep. 23, 1998

[51] Int. Cl.[7] ..... B41J 3/24

[52] U.S. Cl. ..... 400/621; 83/162; 83/401; 83/404; 400/208

[58] Field of Search ..... 400/621, 621.1, 400/208; 83/162, 401, 404; 101/224, 226, 229

[56] References Cited

U.S. PATENT DOCUMENTS

| | | | |
|---|---|---|---|
| 3,091,318 | 5/1963 | Carboni | 400/621 |
| 4,211,498 | 7/1980 | Shimizu et al. | 400/621 |
| 4,216,719 | 8/1980 | Flageliere et al. | 101/227 |
| 4,815,874 | 3/1989 | Richardson et al. | 400/208 |
| 5,556,213 | 9/1996 | Kudo et al. | 400/621 |
| 5,658,083 | 8/1997 | Day et al. | 400/621 |
| 5,746,527 | 5/1998 | Nebashi et al. | 400/621 |

FOREIGN PATENT DOCUMENTS

| | | |
|---|---|---|
| 0 327 075 | 8/1989 | European Pat. Off. . |
| 0 607 026 | 7/1994 | European Pat. Off. . |
| 0 634 275 | 1/1995 | European Pat. Off. . |

*Primary Examiner*—Eugene Eickholt
*Attorney, Agent, or Firm*—Pennie & Edmonds LLP

[57] ABSTRACT

A tape printing device which receives a tape cassette that accommodates a printable tape. The tape cassette includes a housing having a wall portion which is arranged to support the tape during a cutting operation which is performed with a cutting mechanism of the tape printing device. To align the cutting mechanism with the cassette during cutting, the wall portion of the cassette housing is arranged for interacting with a guide mechanism that connects the cutting mechanism and the wall portion during cutting and aligns the cutting mechanism with the wall portion.

18 Claims, 3 Drawing Sheets

TAPE PRINTER HAVING A CUTTER WITH A GUIDE MECHANISM

BACKGROUND OF THE INVENTION

The present invention relates to a tape printing device which utilizes a tape cassette that accommodates a printable tape. In particular, the invention relates to the mechanism for cutting the tape after printing.

Known tape printing devices of the type with which the present invention is generally concerned are disclosed in EP-A-0 322 918 and EP-A-0 322 919 (Brother KK) and EP-A-0 267 890 (Varitronic). Each of these printers includes a printing device having a cassette receiving bay for receiving a cassette or tape holding case. In EP-A-0 322 918, the tape holding case houses an ink ribbon, a transparent image receiving tape and a double-sided adhesive tape which is secured at one of its adhesive coated sides to the image tape after printing and which has a backing paper peelable from its other adhesive side. In each of these devices, the image transfer medium (ink ribbon) and an image receiving tape (substrate) are in the same cassette.

A different type of tape printing apparatus is described in EP-A-0 578 372. In this printing apparatus, the substrate tape is similar to that described in EP-A-0 267 890 but is housed in its own tape holding case while the ink ribbon is similarly housed in its own tape holding case.

In all of these devices, the image receiving tape overlaps with the ink ribbon while passing to a print zone where a fixed print head and a platen, against which the print head is pressed, transfer an image from the ink ribbon to the image receiving tape. There are many ways of accomplishing this transfer, including dry lettering or dry film impression. The most usual way at present is by thermal printing, where the print head is heated and the heat causes ink from the ink ribbon to be transferred to the ink receiving tape. Alternatively, the print head may be in direct contact with a thermally sensitive image receiving tape to generate an image on the image receiving tape when the print head is heated.

When the desired image has been printed onto the image receiving tape, the user must cut off the printed portion of tape from the supply in order to use it as a label. In order to perform this cutting, there exists a variety of cutting mechanisms known in the art, including scissors (EP-A-0 267 890, EP-A-0 327 075, DE-A-4 410 931), blades acting against an anvil (EP-A-0 364 305, EP-A-0 450 779, EP-A-0 719 620), and cooperating cutting blades (EP-A-0 636 562, EP-A-0-734 818).

EP-A-0 634 275 describes a guillotine cutter which protrudes during the cutting operation into a slot of the tape cassette, while the walls of the cassette adjacent to the slot support the tape. In this arrangement, it is necessary to manufacture the cutting mechanism and the cassette within small tolerances, in order to ensure that the cutting blade travels into the cutting slot and does not contact the side walls of the slot or even the portion of the wall of the cassette which supports the tape during cutting. Small tolerances are further required to obtain a cut having an angle of exactly 90 degrees with respect to the longitudinal axis of the tape. A disadvantage of the prior art is thus the necessity to have such small tolerances, which increases productions costs.

SUMMARY OF THE INVENTION

The present invention provides a tape printing device that includes a tape cutting mechanism which is insensitive to mechanical tolerances both of the cutting apparatus and of the tape cassette.

According to a first aspect of the invention, there is provided a tape cassette that accommodates a printable tape and is suitable for being detachably received in a tape printing device having a tape cassette receiving member therein. The tape cassette comprises a housing having a wall portion which is arranged to support a length of the tape in face to face contact while the length of tape is cut in a central area during a cutting operation performed with a cutting mechanism of the tape printing device, with the wall portion supporting the tape on both sides of the cut central area. The tape cassette further comprises at least one guideway provided in the wall portion of the cassette beyond where the tape is supported by the wall portion, with the guideway being arranged for receiving a pin that is connected to the cutting mechanism to align and connect the cutting mechanism and cassette.

The invention proposes to connect the portion of the wall of the tape cassette against which the cutting mechanism acts with the cutting mechanism. This connection is present at least during the cutting operation, and is advantageously released when the user intends to withdraw the cassette from the tape printing device. The connection provides guidance for the cutting mechanism with respect to the tape cassette, such that the cutting zone is at the appropriate location. The cut through the tape will thus be at the desired place and will extend generally orthogonally to the feed direction of the tape. The guide mechanism aligns the cutting mechanism with respect to the tape cassette (which is the preferred embodiment, since it allows the cassette to be fixed with respect to the printing mechanism of the tape printer, hence yielding the best possible printing quality). However, it is also possible to allow the guide mechanism to align the tape cassette with respect to said cutting mechanism.

The guide mechanism comprises a pin fixed to the cutting mechanism which is arranged to protrude into the guideway of the tape cassette during cutting. The guideway can have the form of a hole or a channel. Preferably, the pin and/or the guideway have a rectangular rather than a round section in order to maximize the stiffness and simplify molding.

According to a second aspect of the invention, there is provided a tape cassette that accommodates a printable tape and is suitable for being detachably received in a tape printing device having a tape cassette receiving member therein. The tape cassette comprises a housing having a wall portion which is arranged to support a length of the tape in face to face contact while the length of tape is cut in a central area during a cutting operation performed with a cutting mechanism of the tape printing device, with the wall portion supporting the tape on both sides of the cut central area, wherein the wall portion is configured, positioned and dimensioned for interacting with a guide mechanism which connects the cutting mechanism and the wall portion during cutting such that the cutting mechanism is aligned with respect to the wall portion.

The guideway is advantageously provided within said wall portion of said cassette while the pin is connected to the cutting mechanism. It is also possible to have the guideway mounted to the cutting mechanism and the pin fixed to the wall of the cassette.

A part of the wall portion is arranged to support a length of the tape in face to face contact while the length of tape is cut in a central area during a cutting operation performed with a cutting mechanism of the tape printing device. During the cutting operation, the wall portion supports the tape on both sides of the cut central area. The cutting mechanism can cut against the wall of the cassette which acts as an anvil, as disclosed in EP-A-0 364 305. In another embodiment, the wall portion of the tape cassette further includes a slot arranged to receive a blade of said cutting mechanism during cutting of the tape. This avoids the need of an anvil for cutting. With such an arrangement, it has been found that the cutting force required is significantly reduced, as is the wear of the blade.

Further, the guideway and the pin may be provided adjacent a first lateral end of a blade of said cutting mechanism. The pin is thus located at the end of the blade, such that it does not interfere with the tape during cutting. It should be mentioned that it is preferred to have two pins and guideways, located at opposite sides of the tape, and hence situated at both ends of the cutting blade.

In order to "catch" the pin with the guideway, even when the tape cassette is not exactly aligned with respect to the cutting mechanism, it is proposed that the guideway has a generally conical shape, with the widest opening of the shape facing the pin. Thus, the shape of the guideway, which is in the form of a channel or a deep boring, becomes more narrow the deeper the pin protrudes. Thus, an exact alignment of the cutting mechanism towards the tape cassette is obtained. Alternatively or additionally, the pin can have a conical tip, with its smallest dimensions facing the guideway.

According to another aspect of the invention, there is provided a tape printing device comprising:

a tape cassette receiving member in which a tape cassette can be detachably attached;

a tape cassette comprising a housing having a wall portion which is arranged to support a length of tape in face to face contact relation while the length of tape is cut in a central area, with the wall portion supporting the tape on both sides of the central area;

a tape provided in said tape cassette;

printing means for printing an image on the tape;

a cutting mechanism for cutting off a portion of printed tape; and a guide mechanism arranged for connecting the cutting mechanism and the wall portion of the cassette and for aligning the cutting mechanism with respect to said wall portion during cutting.

DETAILED DESCRIPTION OF THE INVENTION

For a better understanding of the present invention and as to show how the same may be carried into effect, reference will now be made to the accompanying drawings in which.

Figure 1:
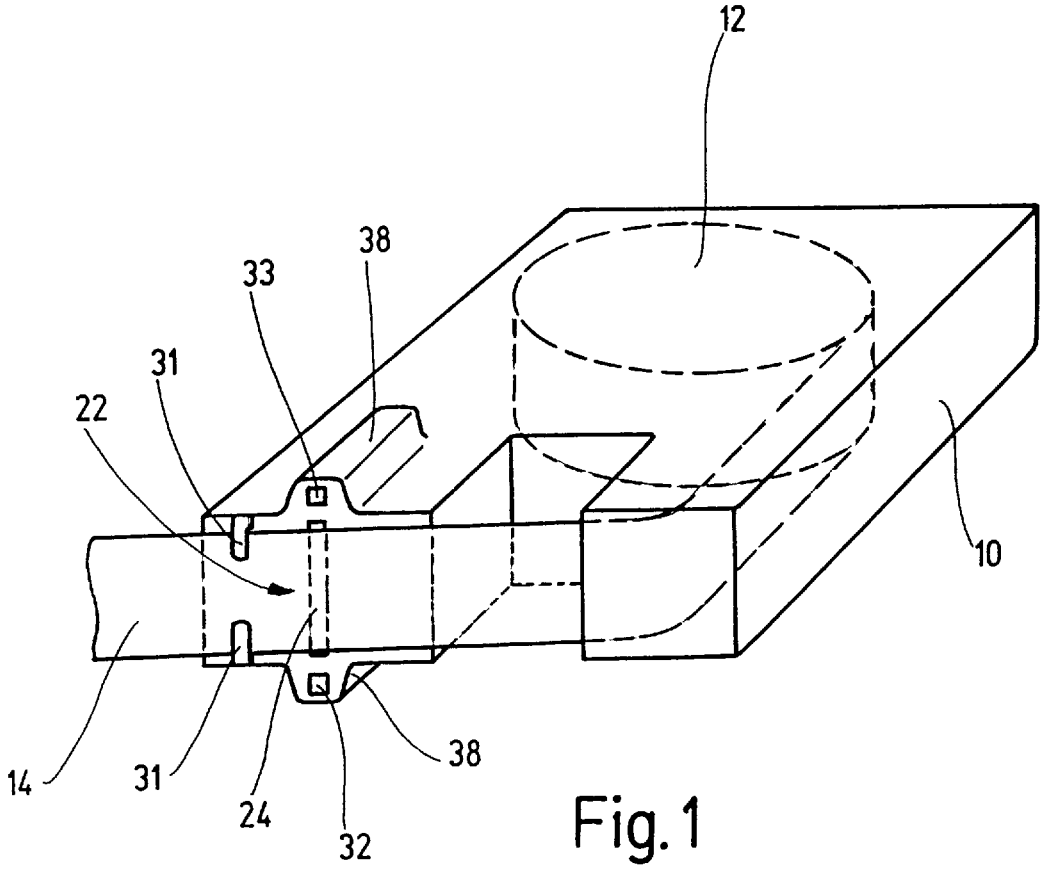
FIG. 1 shows a tape cassette of the invention.

FIG. 1 illustrates a tape cassette 10 according to the present invention. It comprises a housing in which a supply spool 12 with printing tape 14 is accommodated. The printing tape 14 comprises an image receiving layer to which a releasable backing layer is adhered. The user can peel the releasable backing layer from a printed portion of tape 14 and stick the self adhesive tape as a label against surfaces. The cassette of FIG. 1 contains a direct thermal tape. Thus, no ink ribbon is present in the cassette 10. The tape 14 extends from the supply spool 12 through an outlet of the housing of the cassette 10 to a portion 22 of the wall of the housing on which a cutting location is defined. At the cutting location, a slot 24 is defined in the wall portion 22. The tape is guided by means of hooks 31 downstream the slot 24. On both sides of the slot 24, reinforcements 38 are provided on the housing of the tape cassette 10, in which guideways 32, 33, in the form of elongated channels, are situated. The guideways 32, 33 extend orthogonally to the feeding direction of the tape 14 and orthogonally to the length extension of the slot 24. The cross section of the guideways 32, 33 is rectangular.

Figure 2:
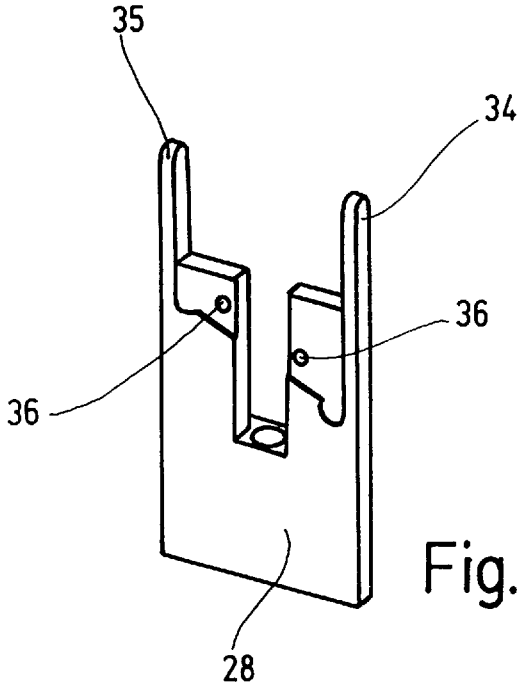
FIG. 2 is a view of a cutter.
Figure 3:
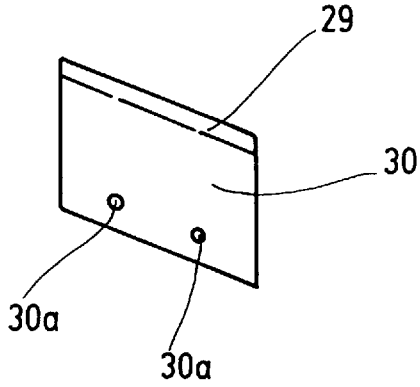
FIG. 3 is a view of a cutting blade.

A cutting mechanism for use with the tape cassette 10 of FIG. 1 is shown in FIG. 2. It comprises a blade holder 28 with pins 36 for holding a blade 30 as shown in FIG. 3. The blade 30 comprises holes 30*a* for mounting the blade to the blade holder 28, whereby the pins 36 extend through the holes 30*a*. The blade 30 can alternatively be fixed by heatstake, ultrasonic weld or screws in the blade holder 28. The blade 30 has an angled cutting edge 29. Adjacent both sides of the space for accommodating the blade 30, the blade holder is provided with pins 34, 35, which fit into the guideways 32, 33 of the tape cassette 10 of FIG. 1. The cross section of the pins 34, 35 is rectangular.

Figure 4:
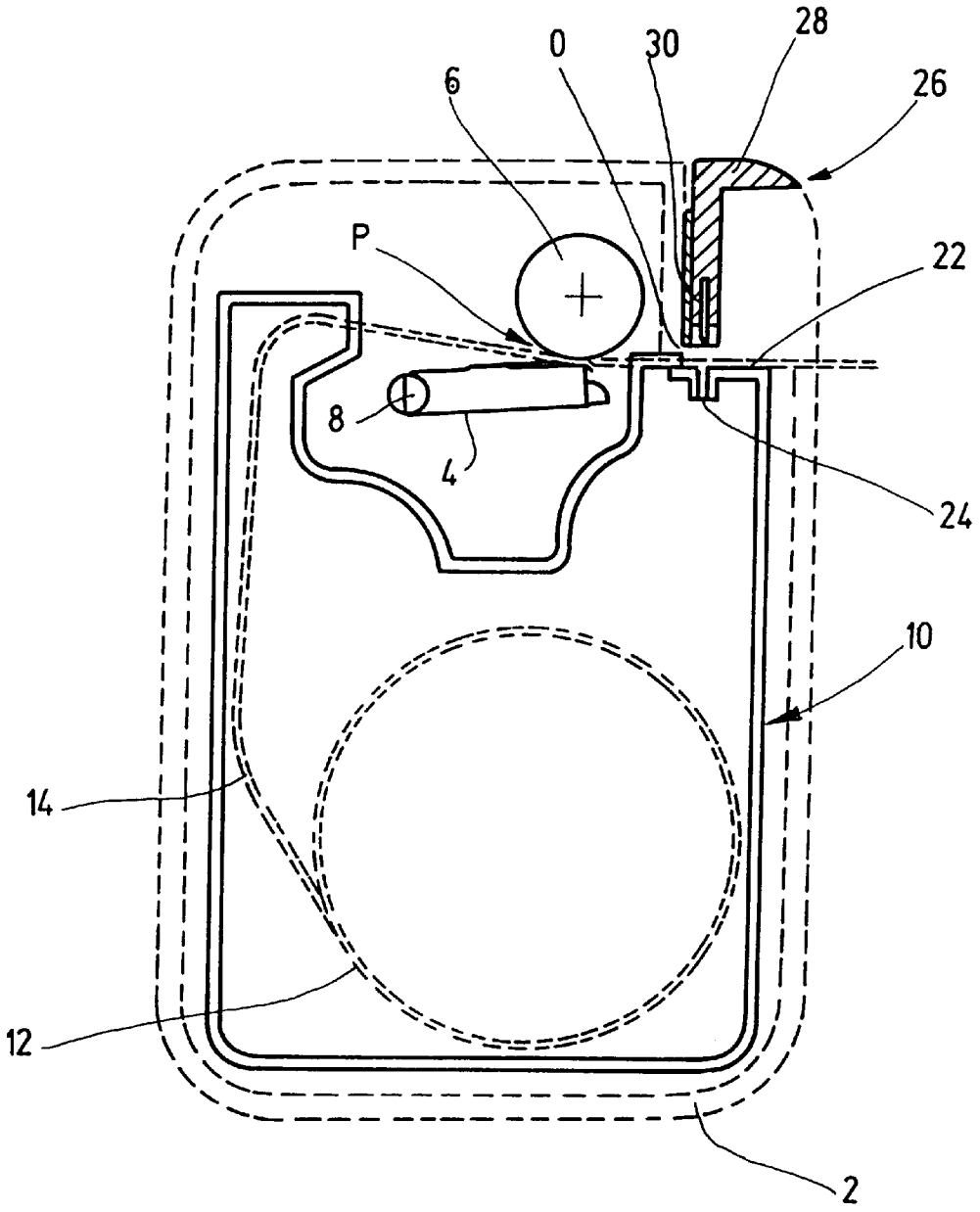
FIG. 4 is a section of a cassette inserted into a tape printing device.

FIG. 4 illustrates a horizontal section of a cassette receiving member of a printing device. The cassette receiving member is shown by the dotted line 2. The cassette receiving member 2 includes a thermal print head 4 and a platen 6 which cooperate to define a print location P in a manner which is known in the art. The print head 4 is pivotable about a pivot point 8 so that it can be brought into contact with the platen 6 for printing and moved away from the platen to enable a cassette 10 to be removed and replaced.

The cassette inserted into the cassette receiving member 2 is denoted generally by reference numeral 10. The cassette holds the supply 12 of image receiving tape 14. The image receiving tape 14 is guided by a guide mechanism (which is not shown) through the cassette, out of the cassette, past the print location P to the cutting location. In the printing device illustrated in FIG. 4, the platen 6 is driven so that it rotates to drive the image receiving tape 14 past the print location P during printing. In this way, tape is printed and fed out from the print location P during printing. The cutting location is provided at a location on a portion of the wall of the cassette which is close to the print location P. The portion of the wall of the cassette 10 where the cutting location is defined is denoted by reference numeral 22. The slot 24 is defined in this wall portion and the image receiving tape 14 is fed past the print location P to the cutting location where it is supported by facing wall portions on either side of the slot 24.

The printing device includes a cutting mechanism denoted generally by reference numeral 26. This cutting mechanism includes the blade holder 28 which carries the blade 30. The blade 30 cuts the image receiving tape 14 and then enters the slot 24 with the leading part of its edge 29 first. It should be appreciated that the pins 34, 35 of the blade holder 28 enter the guideways 32, 33 of the tape cassette 10 simultaneously, such that the cutting mechanism is aligned with respect to the tape cassette 10 (or vice versa). Thus, the angle and position of the blade with respect to the slot 24 is always accurately determined, and the cut is performed at an angle of exactly 90 degrees with regard to the feeding direction of the tape. Further, this arrangement does not allow the blade 30 to interfere with the side walls of the slot 24, which could otherwise be possible as a result of manufacturing tolerances in the current state of the art.

Figure 5:
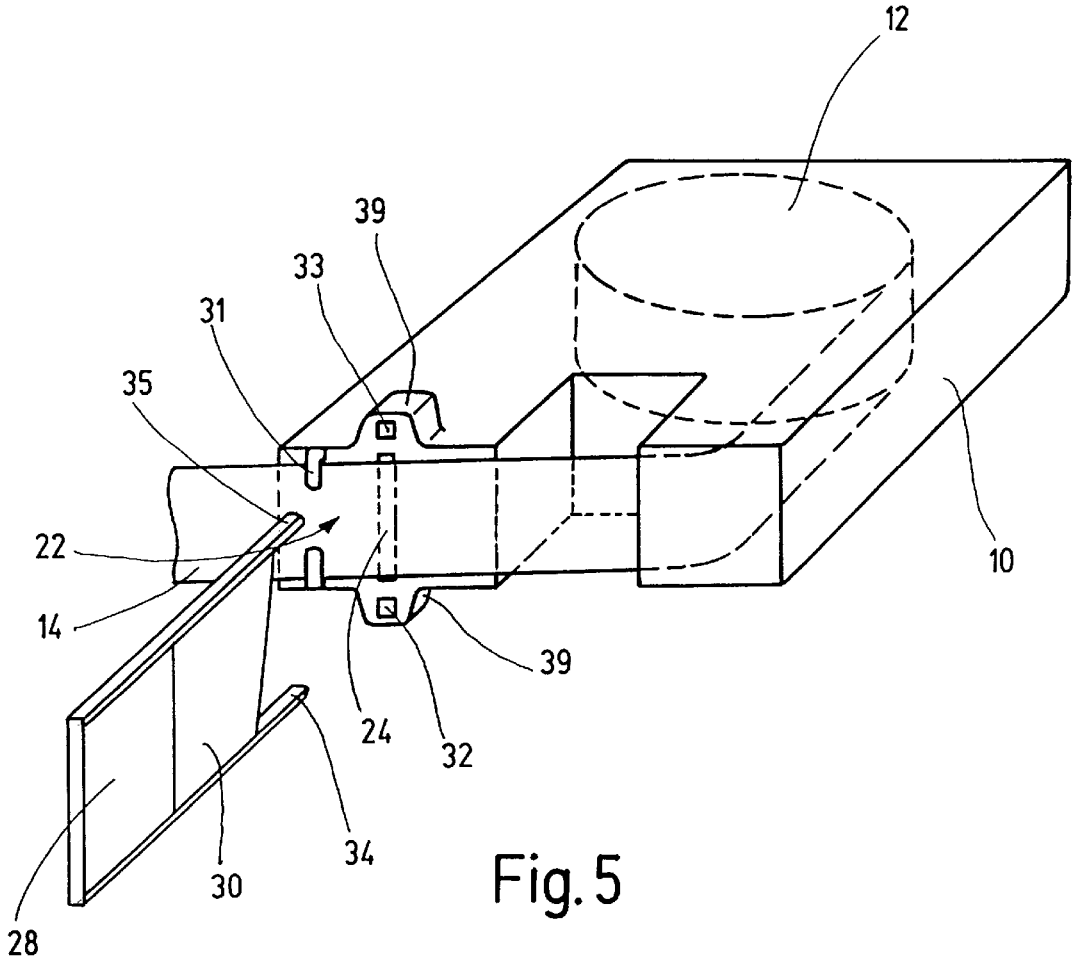
FIG. 5 shows a perspective view of another cassette together with a cutting mechanism of a tape printer.

This functionality is additionally illustrated in FIG. 5, which shows a tape cassette 10 together with a blade holder 28 in its ready-to-operate state. During cutting, pin 34 enters guideway 32, and pin 35 enters guideway 33. In FIG. 5, the guideways 32,33 are somewhat shorter than in FIG. 1. Thus, the guideways in FIG. 5 are holes rather than channels, thereby requiring less material to construct the housing of the cassette 10.

What is claimed is:

1. A tape cassette that accommodates a printable tape and is suitable for being detachably received in a tape printing device having a tape cassette receiving member therein, said tape cassette comprising:

a housing having a wall portion which is arranged to support a length of the tape in face to face contact while the length of tape is cut in a central area during a cutting operation performed with a cutting mechanism of said tape printing device, with the wall portion supporting the tape on both sides of the cut central area; and at least one guideway provided in said wall portion of said cassette beyond where the tape is supported by the wall portion, with the guideway being arranged for receiving a pin that is connected to the cutting mechanism to align and connect the cutting mechanism and cassette.

2. A tape cassette according to claim 1, wherein said guideway is a channel having a rectangular cross section.

3. A tape cassette according to claim 1, wherein said guideway is of generally conical shape, with the widest opening of the shape facing the pin.

4. A tape cassette according to claim 1, wherein said wall portion includes a slot arranged to receive a blade of said cutting mechanism during cutting of the tape.

5. A tape cassette according to claim 1, wherein first and second guideways are provided in the wall portion to receive corresponding first and second pins of the cutting mechanism during cutting, with one guideway positioned above the length of tape and the other positioned below the length of tape.

6. A tape cassette that accommodates a printable tape and is suitable for being detachably received in a tape printing device having a tape cassette receiving member therein, said tape cassette comprising:

a housing having a wall portion which is arranged to support a length of the tape in face to face contact while the length of tape is cut in a central area during a cutting operation performed with a cutting mechanism of said tape printing device, with the wall portion supporting the tape on both sides of the cut central area, wherein said wall portion is configured, positioned and dimensioned for interacting with a guide mechanism which connects the cutting mechanism and said wall portion during cutting such that the cutting mechanism is aligned with respect to said wall portion.

7. A tape cassette according to claim 6, wherein the guide mechanism comprises a pin which is arranged to protrude into a guideway during cutting.

8. A tape cassette according to claim 7, wherein the guideway is provided within said wall portion of said cassette and has the form of a rectangular channel.

9. A tape cassette according to claim 6, wherein said wall portion further includes a slot arranged to receive a blade of said cutting mechanism during cutting of the tape.

10. A tape cassette according to claim 6, wherein the guide mechanism comprises first and second guideways, a first pin located adjacent a first lateral end of a blade of said cutting mechanism and a second pin located adjacent a second lateral end of said blade, wherein the first and second pins are arranged to protrude into corresponding first and second guideways during cutting.

11. A tape cassette according to claim 7, wherein the guideway is of generally conical shape, with the widest opening of the shape facing the pin.

12. A tape printing device comprising:

a tape cassette receiving member in which a tape cassette can be detachably attached;

a tape cassette comprising a housing having a wall portion which is arranged to support a length of tape in face to face contact relation while the length of tape is cut in a central area, with the wall portion supporting the tape on both sides of the central area;

a tape provided in said tape cassette;

printing means for printing an image on the tape;

a cutting mechanism for cutting off a portion of printed tape; and a guide mechanism arranged for connecting the cutting mechanism and the wall portion of the cassette and for aligning the cutting mechanism with respect to said wall portion during cutting.

13. A tape printing device according to claim 12, wherein the guide mechanism comprises a guideway and a pin which is arranged to protrude into the guideway during cutting.

14. A tape printing device according to claim 13, wherein the guideway is provided in the wall portion of the cassette and the pin is provided on the cutting mechanism.

15. A tape printing device according to claim 13, wherein the pin has a conical tip, with its smallest dimensions facing the guideway.

16. A tape printing device according to claim 13, wherein the pin has a rectangular cross section.

17. A tape printing device according to claim 12, wherein said wall portion includes a slot arranged to receive a blade of said cutting mechanism during cutting of the tape.

18. A tape printing device according to claim 12, wherein the guide mechanism comprises first and second guideways, a first pin located adjacent a first lateral end of a blade of said cutting mechanism and a second pin located adjacent a second lateral end of said blade, wherein the first and second pins are arranged to protrude into corresponding first and second guideways during cutting.

* * * * *